US006644879B2

(12) United States Patent
Irvin et al.

(10) Patent No.: US 6,644,879 B2
(45) Date of Patent: Nov. 11, 2003

(54) STAIN REMOVAL PEN WITH OPTIMAL APPLICATION DEVICE

(75) Inventors: Ann Margaret Irvin, Richmond (GB); Paul Meredith, Brisbane (AU); David Roy Sandbach, Overijse (BE); Jean Wevers, Steenhuffel (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/041,168

(22) Filed: Jan. 8, 2002

(65) Prior Publication Data

US 2003/0035680 A1 Feb. 20, 2003

(51) Int. Cl.[7] ..... B43M 1/00; B43M 17/00
(52) U.S. Cl. ..... 401/198; 401/196; 401/267
(58) Field of Search ..... 401/198, 199, 401/196, 267

(56) References Cited

U.S. PATENT DOCUMENTS

| | | | | |
|---|---|---|---|---|
| 3,748,268 A | | 7/1973 | Loudas | |
| 5,122,158 A | | 6/1992 | Kuroda et al. | |
| 5,288,420 A | | 2/1994 | Mandy | |
| 5,324,131 A | | 6/1994 | Gardner, III | |
| 5,611,687 A | | 3/1997 | Wagner | |
| 5,765,407 A | | 6/1998 | Choo et al. | |
| 5,872,090 A | | 2/1999 | You et al. | |
| 6,386,781 B1 | * | 5/2002 | Gueret | 401/198 |
| 2002/0090251 A1 | | 7/2002 | Sandbach | |
| 2002/0091070 A1 | | 7/2002 | Engisch | |
| 2002/0198126 A1 | | 12/2002 | Irvin | |
| 2003/0019046 A1 | | 1/2003 | Boissie | |

FOREIGN PATENT DOCUMENTS

| | | | | |
|---|---|---|---|---|
| DE | 2 422 191 | | 11/1975 | |
| DE | 195 36 714 A1 | | 4/1997 | |
| EP | 0 205 999 | | 12/1986 | |
| GB | 1016053 | * | 1/1966 | 401/198 |
| WO | WO 85/00782 | | 2/1985 | |
| WO | WO 97/20099 | | 6/1997 | |
| WO | WO 99/02769 | | 1/1999 | |

* cited by examiner

*Primary Examiner*—Gregory L. Huson
*Assistant Examiner*—Kathleen J. Prunner
(74) *Attorney, Agent, or Firm*—Julia A. Glazer; Brahm J. Corstanje; Kim W. Zerby

(57) ABSTRACT

An applicator for a fabric treatment to effect mechanical stain removal has a no rinse fabric treatment composition and an application device. The application device induces a certain frictional stress upon the fabric and has a frictional stress value on the fabric optimally chosen to effect fabric treatment and is at the same time kind to the fabric. Advantageously, the application device has a frictional stress value of from 0.05 N $mm^{-2}$ to 1 N $mm^{-2}$. The frictional stress should be high enough to ensure good mechanical stain removal, good delivery of the fabric treatment composition into the fabric and allow fabric treatment with fabric friendly chemical compositions at low levels.

10 Claims, No Drawings

STAIN REMOVAL PEN WITH OPTIMAL APPLICATION DEVICE

FIELD OF THE INVENTION

The present invention relates to an applicator for a fabric treatment composition and its application. More specifically the invention relates to a convenient to carry fabric treatment applicator comprising an application device, such as a nib, which is optimised with regard to the frictional stress induced upon a fabric and which comprises a fabric treatment composition which does not require post-treatment rinsing.

BACKGROUND OF THE INVENTION

Portable stain removers for pre laundry application, post laundry application or application on fresh stains, also in forms of applicators for a liquid composition are known articles of manufacture. Similarly, portable applicators for the application of other liquid compositions are known, for example in the field of ink removal. Prior art in this field includes the following documents:

U.S. Pat. No. 5,288,420 discloses a stain removal composition provided in form of a solid stick, which can be applied to selected areas of a fabric in laundry preparations. Various compositions are disclosed comprising surfactants, enzymes and glycols. U.S. Pat. No. 3,748,268 discloses a stain removal composition especially for carpets and upholstery comprising surfactant for an aerosol formulation. EP 0 205 999 discloses to provide a laundry preparation composition in the form of a solid stick. WO 85/00782 discloses a kit comprising coloured fluids and an eradicator for these fluids, which can be used on various materials including clothing. DE 2422191 discloses a solution to be used on stains provided in an applicator with a felt insert. DE 19536714 discloses an applicator for a stain removal fluid which takes the form of a pen. WO 99/02769 discloses an impregnated towelette to clean stains from clothes and upholstery, comprising surfactant.

Applicators comprising bleach are known in other fields than fabric treatment: U.S. Pat. No. 5,324,131 discloses an applicator for a liquid bleaching agent to be used to eradicate or remove an emphasising ink. The applicator may be provided with a felt tip or roller. U.S. Pat. No. 5,611,687 discloses an oral fluid, e.g. for the teeth or the gum, and an applicator for it comprising a broad fibre tip or a roller ball.

None of the above patents gives details how the various applicators should be used. Prior art documents which address the application of the respective compositions with some detail include the following documents:

U.S. Pat. No. 5,765,407 describes an on-the-spot stain removal kit, comprising four sponges, and teaches a four step stain removal procedure for satisfactory results.

U.S. Pat. No. 5,122,158 discloses an applicator for an enzyme-containing liquid detergent for the application in laundry preparation. The applicator comprises a porous body made of a synthetic plastic material. The heat resulting from the friction produced by the applicator during application to a fabric is assumed to contribute to a more rapid enzymatic reaction.

WO 97/20099 discloses an applicator for the post-laundry treatment of fabrics. A two step process is taught which involves the use of an iron on one side of the fabric and the use of an absorbent layer on the other side of the fabric. The application of heat and/or pressure by means of an iron is believed to affect the physical characteristics of the stained fabric, such as its viscosity.

U.S. Pat. No. 5,872,090 discloses a stamp like applicator for a fabric treatment composition comprising bleach and surfactant, which is to be applied to a fabric in a rocking motion. The treatment is preferably done on a table top and preferably using an absorbent stain remover situated beneath the fabric and followed by a post treatment process in a hot air cloth dryer. A rubbing action as opposed to a rocking action is expressly taught to be of disadvantage as to minimise fabric damage.

The Helmac Stain Eraser, as marketed on the internet by the Helmac Products Corporation, incorporates a plastic tip for rubbing. The device according to the usage instructions is not recommended for use on silk, suede or leather. A stain removal treatment with this device further requires a post-treatment step of removing the stain or residues of the fabric treatment liquid by rinsing the stain away with water or blotting with a moist cloth.

None of the mentioned prior art has recognised the advantage of the careful selection of the properties of the application device, e.g. nib or sponge, with regard to the frictional stress induced upon fabric in the stain removal process.

It is hence an objective of the present invention to provide an applicator for a fabric treatment composition, which allows effective mechanical stain removal.

It is a further objective of the present invention to provide an applicator for a fabric treatment composition, which allows single step application.

It is still a further objective of the present invention to provide an applicator for a fabric treatment composition, which does not leave residues even when no rinsing or other post treatment of the fabric is undertaken.

It is yet a further one objective of the present invention to provide an applicator for a fabric treatment composition, which is easy to use.

It is another objective of the present invention to provide an applicator for a fabric treatment composition, which is convenient to store and to carry.

It is yet another objective of the present invention to provide an applicator for a fabric treatment composition, which does not dry out when stored over extended periods of time.

It is still an additional objective of the present invention to provide an applicator for a fabric treatment composition, which can be successfully used on a large variety of stains and fabrics.

These and other objectives, as apparent from the following description, are addressed by the present invention.

SUMMARY OF THE INVENTION

The present invention relates to an applicator for a fabric treatment composition and its application. More specifically the invention relates to a versatile, effective convenient to apply fabric treatment applicator. Claimed and described is an applicator for a fabric treatment composition, which does not require rinsing, comprising an application device, which induces a certain frictional stress upon fabric.

DETAILED DESCRIPTION OF THE INVENTION

In accordance with the present invention a fabric treatment applicator is optimised with regard to its mechanical performance so as to induce a certain frictional stress upon fabric. The optimally chosen frictional stress supports effective fabric treatment, namely stain removal, and is at the same time kind to the fabric. The frictional stress should not be so high as to induce damage upon the fabric. However, the frictional stress should be high enough as to ensure good mechanical stain removal and good delivery of the fabric treatment composition into the fabric and therefore allow fabric treatment with fabric friendly chemical compounds at low levels, thus making the present invention suitable for delicate fabrics including silk and a no rinse treatment.

Preferred Compositions

Any no rinse composition which can be used for fabric treatment is within the scope of the present invention. Preferred are fabric friendly compositions, in particular stain removal compositions as described below.

Rinsing, as used herein, refers to localised a post-treatment step immediately following the fabric treatment, e.g. stain removal step. For example, rinsing encompasses treatment with a moist cloth and any localised application of for example any fluid, such as water, a solvent and the like. A no rinse fabric treatment composition, as used herein, is a composition, which does not leave visible residues on a treated fabric when the fabric is not rinsed. Residues are considered not visible, when they receive a rating of less than 2.5 panel score unit in the Residue Test Method described below. Preferred no rinse fabric treatment composition afford a rating of less than 1.5, more preferably less than 1.0, yet more preferably less than 0.5 panel score units.

Stain Removal Compositions

One problem associated with known fabric treatment compositions hereinafter referred to as stain removal compositions is their tendency to leave visible residues on fabric surfaces. Such residues are problematic and are preferably to be avoided herein since the present process does not involve conventional immersion or rinse steps. Accordingly, the stain removal compositions herein should, most preferably, be substantially free of various polyacrylate-based emulsifiers, polymeric anti-static agents, inorganic builder salts and other residue-forming materials, except at low levels of 0.1%–0.3%, and preferably 0%, of the final compositions (%, as used herein, denotes % by weight of 100% active). Water used in the compositions should preferably be distilled, deionized or otherwise rendered free of residue-forming materials.

Accordingly, in a preferred aspect of this invention there are provided stain removal compositions which are substantially free of materials which leave visible residues on the treated fabrics. This necessarily means that the preferred stain removal compositions are formulated to contain a high level of volatile materials, preferably water, preferably 95%, a cleaning solvent such as BPP at a low, but effective, level, typically 1% to 4%, preferably 2%, hydrogen peroxide at a level from 1% to 3%, preferably 2%, and surfactant at levels of 0.1% to 1%. Advantageously, when thus formulated such compositions exist as phase-stable aqueous solutions rather than as suspensions or emulsions. Thus, such compositions do not require use of additional emulsifiers, thickening agents, suspending agents, and the like, all of which can contribute to the formation of undesirable visible residues on the fabric.

Indeed, as an overall proposition, the chemical compositions which are used to provide the stain removal and the overall cleaning and/or refreshment functions herein comprise ingredients which are safe and effective for their intended use, and, as noted above, do not leave unacceptable amounts of visible residues on the fabrics. While conventional laundry detergents are typically formulated to provide good cleaning on cotton and cotton/polyester blend fabrics, the compositions herein must be formulated to also safely and effectively clean and refresh fabrics such as wool, silk, rayon, rayon acetate, and the like. In addition, the compositions herein comprise ingredients which are specially selected and formulated to minimize dye removal or migration from the stain site of fugitive, unfixed dye from the fabrics being cleaned. The preferred compositions herein are formulated to minimize or avoid these problems.

The dye removal attributes of the present compositions can be compared with art-disclosed cleaners using photographic or photometric measurements, or by means of a simple, but effective, visual grading test, the dye removal test described below.

In addition to the foregoing considerations, the compositions used herein are preferably formulated such that they are easily dispensed and not so viscous or self-adhesive in nature that they render the stain removal applicator unhandy or difficult to use. Preferably the fabric treatment compositions described herein are formulated as liquid fabric treatment compositions. In one alternative they may be provided as a gel. A stain removal composition according to the present invention comprises:

(a) Bleach—The compositions herein comprise from 0% to 99.99%, preferably 0.001% to 7%, by weight, of bleach, preferably peroxide bleach, most preferably hydrogen peroxide. More preferred spot cleaners will comprise 0.5% to 3% hydrogen peroxide. It will be appreciated that peroxide sources other than $H_2O_2$ can be used herein. Thus, various per-acids, per-salts, per-bleaches and the like known from the detergency art can be used. However, such materials are expensive, difficult to formulate in liquid products, can leave residues on fabrics and offer no special advantages over $H_2O_2$ when used in the present manner.

(b) Surfactant—The compositions herein comprise from 0% to 99.99%, preferably 0.05% to 5%, more preferably 0.05% to 2% by weight of surfactants, such as ethoxylated alcohols or alkyl phenols, alkyl sulfates, NaAES, NH4AES, amine oxides, and mixtures thereof. As noted above, use of surfactants limited to the lower end of the range is preferred for some dyes and fabric types. Typically, the weight ratio of BPP solvent:surfactant(s) is in the range of from about 10:1 to about 1:1. One preferred composition comprises 2% BPP/0.8% AES. Also, nonionics such as the ethoxylated C10–C16 alcohols, e.g., NEODOL 23–6.5, can be used in the compositions. The alkyl sulfate surfactants which may be used herein as cleaners and to stabilize aqueous compositions are the C8–C18 primary ("AS"; preferred C10–C14, sodium salts), as well as branched-chain and random C10–C20 alkyl sulfates, and C10–C18 secondary (2,3) alkyl sulfates of the formula CH3(CH2)x(CHOSO3-M+) CH3 and CH3 (CH2)y(CHOSO3-M+) CH2CH3 where x and (y+1) are integers of at least 7, preferably at least 9, and M is a water-solubilizing cation, especially sodium, as well as unsaturated sulfates such as oleyl sulfate. Alkyl ethoxy sulfate (AES) surfactants used herein are conventionally depicted as having the formula R(EO)xSO3Z, wherein R is C10–C16 alkyl, EO is —CH2CH2—O—x, is 1–10 and can include mixtures which are conventionally reported as averages, e.g., (EO) 2.5, (EO)6.5 and the like, and Z is a cation such as sodium ammonium or magnesium (MgAES). The C12–C16 alkyl dimethyl amine oxide surfactants can also be used.

(c) Solvent—The compositions herein may comprise from 0% to 99.99% preferably from 0% to 10% by weight, of butoxy propoxy propanol (BPP) solvent or other solvents as described herein. Organic solvents are preferred for use in the present compositions. Preferred spot cleaners will comprise 1–4% BPP which is available in commercial quantities as a mixture of isomers in about equal amounts. The isomers, and mixtures thereof, are useful herein. The isomer structures are as follows:

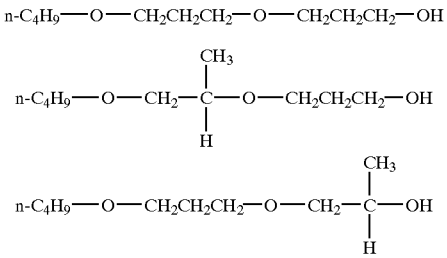

Other useful solvents are hydrotropes such as sodium toluene sulfonate and sodium cumene sulfonate, short-chain alcohols such as ethanol and isopropanol, and the like. They can be present in the compositions as only solvents or in combination with other solvents.

(d) Water—The preferred, low residue compositions herein may comprise from 0% to 99.99%, preferably from 70% to 99.99%, more preferably 90% to 99.9%, most preferably from 94.0% to 99.0%, by weight, of water and hence are preferably aqueous solutions. Water used in the compositions should preferably be distilled, deionized or otherwise rendered free of residue-forming materials.

(e) Other Optionals—The compositions herein may comprise minor amounts of various optional ingredients, including enzymes, preservatives, anti-static agents, fragrances, odor absorbing components, and the like. If used, such optional ingredients will typically comprise from 0.0001% to 10%, more preferably from 0.01% to 2%, by weight, of the compositions, having due regard for residues on the cleaned fabrics. Preferred optionals are namely the following:

Chelator—The chelating agent is selected from those which, themselves, are stable in aqueous $H_2O_2$ and which stabilize the $H_2O_2$ by chelating vagrant metal ions. Such chelating agents are typically already present at low, peroxide-stabilizing amounts (0.01%–1%) in commercial sources of hydrogen peroxide.

Enzymes—Besides the optional surfactants in the stain removal compositions herein can contain enzymes to further enhance cleaning performance. Lipases, amylases and protease enzymes, or mixtures thereof, can be used. If used, such enzymes will typically comprise from 0.001% to 5%, preferably from 0.01% to 1%, by weight, of the composition. Commercial detersive enzymes such as LIPOLASE, ESPERASE, ALCALASE, SAVINASE and TERMAMYL (all ex. NOVO) and MAXATASE and RAPIDASE (ex. International Bio-Synthesis, Inc.) can be used.

Preservatives—The compositions herein can optionally be preserved for storage using conventional preservatives such as KATHON® at a level of 0.0001%–1%, by weight.

Anti-static agents—If an antistatic benefit is desired, the compositions used herein can contain an anti-static agent. If used, such anti-static agents will typically comprise at least 0.5%, typically from 2% to 8%, by weight, of the compositions. Preferred anti-stats include the series of sulfonated polymers available as VERSAFLEX 157, 207, 1001, 2004 and 7000, from National Starch and Chemical Company Fragrances—The odor absorbing composition of the present invention can also optionally provide a "scent signal" in the form of a pleasant odor which signals the removal of malodor from fabrics. The scent signal is designed to provide a fleeting perfume scent, and is not designed to be overwhelming or to be used as an odor masking ingredient. When perfume is added as a scent signal, it is added only at very low levels, e.g., from 0% to 0.5%, preferably from 0.003% to 0.3%, more preferably from 0.005% to 0.2%, by weight of the usage composition.

Perfume can also be added as a more intense odor in product and on surfaces. When stronger levels of perfume are preferred, relatively higher levels of perfume can be added. Any type of perfume can be incorporated into the composition of the present invention.

Odor absorbing components—The compositions of the present invention may further comprise an optional cyclodextrin. This will impart the composition with odour absorbing properties, which is especially useful for application on inanimate surfaces to control the malodour.

As used herein, the term "cyclodextrin" includes any of the known cyclodextrins such as unsubstituted cyclodextrins containing from six to twelve glucose units, especially, alpha-cyclodextrin, beta-cyclodextrin, gamma-cyclodextrin and/or their derivatives and/or mixtures thereof. The preferred cyclodextrins are available, e.g., from Cerestar USA, Inc. and Wacker Chemicals (USA), Inc.

Typical levels of cyclodextrin in usage compositions for usage conditions are from 0.01% to 5%, preferably from 0.1% to 4%, more preferably from 0.2% to 2% by weight of the composition.

The preselected pH range of the stain removal compositions assists in stabilising the hydrogen peroxide present and is typically in the acid-slightly basic range from about 3 to about 8, preferably about 6.

A stain removal composition comprising water, surfactant and bleach is efficient in treating a large variety of stains. It is known that various greasy stains are best treated with a surfactant whereas other common stains such as from grass, tomato sauce or wine are best treated with bleach, while water soluble stains can normally effectively removed with water.

While referring to stain removal compositions, the compositions disclosed herein may also favourably be used in other contexts, for example for bleaching and/or sanitation of non-stained fabrics.

Examples of Stain Removal Compositions

Having due regard to the foregoing considerations, the following illustrates preferred examples of stain removal compositions, but is not intended to be limiting thereof.

EXAMPLE 1

| | % (wt) of 100% active component formula range |
|---|---|
| BPP | 1.0–2.0 |
| Hydrogen peroxide | 1.5–3.0 |
| Alkyl sulfate surfactant | 0.3–1.0 |
| Perfume | 0.005–0.01 |
| Ethanol | 0.3–1.0 |
| EDTA | <0.01 |
| Water | Balance |

EXAMPLE 2

| | % (wt) of 100% active component formula range |
|---|---|
| BPP | 1.0–2.0 |
| Hydrogen peroxide | 1.5–3.0 |
| LIPOLASE | 0.3–0.5 |
| Alkyl sulfate surfactant | 0.3–1.0 |
| Perfume | 0.005–0.01 |
| Ethanol | 0.3–1.0 |
| EDTA | <0.01 |
| Water | Balance |

Applicators

According to the present invention the applicator by means of its application device should induce a certain friction upon the fabric, on which it is to be used. This largely helps efficient removal of a stain.

The application device, as used herein, is a device which in use is in contact with the surface on which the fabric treatment applicator is used and delivers the fabric treatment composition to that surface. Preferred application devices include any felt, non-woven material, sponge, or foam insert, for example in the form of a porous pad, and most preferably in the form of a nib. Another preferred application device is a roller ball. Other preferred application devices are all those used to apply a writing fluid to paper, e.g. as used in a fountain pen. For a wipe or towelette applicator the whole wipe or towelette is encompassed by the term application device. If the fabric treatment composition is provided in solid stick form, the whole solid stick is encompassed by the term application device. Applicators having only one application device, most preferably a nib are preferred.

Without wishing to be bound by theory it is believed that the performance of the application device with regard to stain removal is largely influenced by the friction induced by the application device upon a fabric. Again without wishing to be bound by theory it is believed that the frictional behaviour is best described in terms of frictional stress. The frictional stress value is defined as the force exerted upon a reference fabric per unit area of real contact and is measured as given below.

The frictional stress of an application device is of particular importance as it is an indicator of the efficiency with which the mechanical energy provided by the user is transferred to the fabric to abrade a stain and/or deliver the fabric treatment composition onto and into any chosen area of the fabric. When an application device is inefficient, as indicated by a low frictional stress value, the energy supplied by the user is dissipated in other ways, for example, through the application device itself deforming or tearing.

The frictional stress of an application device, σ, is defined as:

$$\sigma = \frac{F}{A} = \frac{\mu R}{A}$$

where F is the frictional force, A the contact area, $\mu$ the coefficient of friction and R the reaction to the normal load. Frictional stress values, as measured in the method detailed below, of greater than 0.05 N $mm^{-2}$ have been shown to be advantageous, more preferably the frictional stress values are from 0.05 N $mm^{-2}$ to 10 N $mm^{-2}$, yet more preferably from 0.1 N $mm^{-2}$ to 1 N $mm^{-2}$ and most preferably from 0.2 N $mm^{-2}$ to 0.4 N $mm^{-2}$.

Generally all applicators inducing the specified frictional stress upon a fabric and allowing for a no rinse treatment are within the scope of the present invention. The choice of a particular applicator will largely depend on the usage envisaged. For example a wipe or a towelette applicator providing the desired frictional stress may be chosen. Such wipes or towelette may be packaged individually or a plurality of them may be packaged together. Preferably such package prevents evaporation of the compositions disclosed herein.

Preferred applicators comprise a housing comprising a reservoir for the storage of a composition. Such a housing may be a bottle of any shape or size. Preferred shapes for such housings are hollow barrel shapes, most preferably having a diameter to length ratio from 1:30 to 1:2, so as to be convenient to hold in the user's hand, use and store. More preferred are housings of a diameter to length ratio from 1:20 to 1:5, which resemble in shape a pen, e.g. a ball pen or a highlighter pen, and which are herein referred to as pen-shaped. The reservoir may be filled with an absorbent material, such as a wadding or a cartridge style device such as those commonly found in ink pens able to release liquid on demand. The housing may be made of any solid material, which may also be flexible, such as glass or any plastic material. A preferred material is polypropylene. The application device is preferably comprised by the housing, most preferably one application device is comprised, most preferably a nib.

Such nib typically is a fibre-tip nib as commonly found in children's colouring pens or highlighting pens. A nib according to the present invention does preferably not comprise a single opening or channel to deliver the fabric treatment composition. Such an opening or channel does not allow for very controlled delivery of the fabric treatment composition. Hence, either insufficient composition will be delivered for effective cleaning or unnecessary large amounts of composition may be delivered, the latter leading to longer drying times for the treated fabric or in some cases possibly even to residues. Moreover, an opening or channel leading to the reservoir promotes the evaporation of volatile compounds of the composition stored therein and may further induce leaking when the fabric treatment applicator is transported. The same disadvantages are associated with a porous application device. Hence, a nib in accordance with the present invention preferably has a pore size of less than 300 $\mu$m. Preferably pores which may be present in a nib according to the present invention have a size from 1 $\mu$m to 200 $\mu$m, more preferably from 5 $\mu$m to 100 $\mu$m, more preferably from 10 $\mu$m to 50 $\mu$m.

Preferably the nib has a pointy shape, most preferably being cone- or wedge-shaped. A cone-shaped nib allows to exert pressure on a relatively narrow area, as benefical for mechanical stain removal, without leading to damage of the nib, which is thicker and hence more stable closer to the housing. A cone- or wedge-shaped nib also allows the fabric treatment composition to be applied to a small selected area as beneficial for low moistening of the fabric and low residues.

The nib should be in contact with the reservoir directly or indirectly so as to allow transfer of the fabric treatment composition to the nib during use. The nib may be made of any synthetic or man-made or natural materials such as felt, open cell foam, closed cell foams, polyethylene, nylon etc. A preferred material for the nib is felt, most preferably provided from synthetic fibres.

The nib while being held by the housing has a section external to the housing, this section preferably measures from 3.0 cm to 0.1 cm, more preferably from 1.0 cm to 0.25 cm, most preferably from 0.75 cm to 0.5 cm in length.

The contact area—measured as given below—between the application device and a flat surface preferably is from 0.25 $mm^2$ to 400 $mm^2$, more preferably from 1 $mm^2$ to 100 $mm^2$, most preferably from 4 $mm^2$ to 10 $mm^2$. Such a contact area ensures optimal mechanical stain removal and allows for application of the fabric treatment composition to small selected areas.

Preferred application devices according to the present invention also exhibit a certain delivery volume efficiency—measured as described below. The delivery volume efficiency is defined as the amount of fluid (ml) delivered to the fabric per unit time per unit area ($s^{-1}$ $mm^{-2}$). The right delivery volume efficiency ensures that a sufficient but not too high amount of fabric treatment composition is delivered giving the benefits of a sufficient and constant flow rate and further the benefit of avoiding drying out of the nib (10) or the reservoir in between uses. The delivery volume efficiency is preferably from 0.0005 ml $mm^{-2}$ $s^{-1}$ to 0.1 ml $mm^{-2}$ $s^{-1}$ and more preferably from 0.001 ml $mm^{-2}$ $s^{-1}$ to 0.01 ml $mm^{-2}$ $s^{-1}$.

The applicator may also comprise a cap to prevent evaporation of the composition and to prevent any unattended contact of the application device with objects when not used.

Methods of Application

The use of any applicator with any composition disclosed herein will depend on the applicator itself and also on the object on which the applicator is to be used.

The compositions disclosed herein may find usage on any surface of a material in direct or indirect contact with the human body, which inter alia are all encompassed by the term fabric. Those surfaces are typically soft surfaces comprised by materials such as soft plastic materials, leather and textile fabrics. Textile fabrics namely are found in clothing, including shirts, ties, blouses, socks, skirts, trousers, jackets, underwear, watch straps etc.

Moreover these compositions can be used on fabrics comprised by carpets, curtains or upholstery and the like.

For a fabric treatment applicator comprising a housing and an application device, the cap covering the application device, if present, is removed before application. The application device is then brought into contact with a selected area of an fabric. For some application devices exertion of pressure may be needed to release the composition from the applicator. The pressure initially needed for this purpose may be higher than the pressure needed to ensure constant the flow of the composition. Wiping or otherwise moving the application device over the selected application area may also be required to deliver the composition to all parts of this area and may help to uniformly apply the composition. Rubbing, i.e. wiping while exerting pressure towards the fabric, may help in the mechanical removal of stains.

The application of any composition disclosed herein, may be one step of a more comprehensive treatment of a fabric. The treatment may for example comprise preparing steps, such as removing larger amounts of a stain inducing material, e.g. food, with a serviette or the like.

However, a stain removal treatment carried out with an applicator according to the present invention does not comprise a rinsing step for the removal of a stain. A rinsing step is not needed, since the fabric treatment applicators disclosed herein are highly efficient in removing any stains, including water soluble ones. Moreover, post-treatment of a fabric under running water or with a moist cloth is not required—neither as not to lease residues nor for mechanical removal of a stain—due to the effective mechanical removal of any stains by means of the disclosed application device and the residue free treatment by the chemical compositions used.

Furthermore, an additional step such as a drying step is normally not needed, since the compositions disclosed herein promote quick drying and the applicators disclosed herein allow application of low amounts of a fabric treatment composition to small areas.

Test Methods

Dye Removal Test

An expert panel assists in visual grading. Thus, in one such test, swatches of fabric are individually dyed with a dye from a representative dye category such as from reactive dyes, sulphur dyes, vat dyes, direct dyes and azoic dyes. A swatch of fabric is prepared with a dye from each category. A measured area within each swatch is treated with the fabric treatment composition and allowed to dry. Any dye removal in the treated swatch is assessed visually by comparing the treated area of the swatch with the surrounding untreated area of the swatch. Numerical units ranging from: (0) 'no difference between both fabrics', (1) 'I think there is a difference', (2) 'I'm sure there is a difference', (3) 'there is a big difference', (4) 'there is a huge difference' are assigned by panelists. The test is repeated three times of any swatch and an average value is calculated.

Measurement of Frictional Stress

The application device is clamped to the load arm of a Plint dual axis reciprocating rig (such as model TE75R, MRPRA RUBBER CONSULTANTS). The angle of the fabric treatment applicator relative to the contact surface is adapted to maximise the contact area. Angles of the fabric treatment applicator relative to the contact surface for which the angle between the vertical axis of the fabric treatment applicator (a line connecting the centre of the contact area with the centre of mass of the fabric treatment applicator defines the vertical axis.) and the contact surface less than 45° are not considered (since they are not typical for a consumer preferred application method). The clamping arrangement provided a consumer realistic vertical load, R, on the application device of 3N. The coefficient of friction is then measured between the application device and a 100% cotton fabric as used in mens' shirts mounted on soft counter surface provided by a 2 mm thick sheet of soft rubber mounted with double-sided adhesive to a flat aluminium plate. The application device is measured wet using a composition as given in Example 1. The coefficient of friction is measured over the central 10 mm of four traverses of 20 mm in both the forward and reverse direction at a speed of 1 mm $s^{-1}$ and an average value calculated. Measurements with the application device in final measuring position are repeated three times to check reproducibility.

Measurement of Contact Area

Measurements of the contact area of the application device are carried out with a fabric treatment applicator which contains a dry application device and no treatment composition. The dry application device is inked by pressing it against an ink stamp pad and then clamping the fabric treatment applicator to the load arm of a plint dual axis reciprocating rig (such as model TE75R, MRPRA RUBBER CONSULTANTS). A mark on a contact surface which is representative of the contact area of the application device is obtained by controlled lowering and raising of the plint load arm towards and away from the contact surface. The angle of the fabric treatment applicator relative to the contact surface is adapted to maximise the contact area. Angles of the fabric treatment applicator relative to the contact surface for which the angle between the vertical axis of the fabric treatment applicator (as defined above) and the contact surface less than 45° are not considered (since they are not typical for a consumer preferred application method). The contact time should be approximately 1s while a 3N load should be applied on the application device. The contact area can then be calculated from the mean length and width of the mark determined using a magnifying lens with a graticule. Measurements with the application device in final measuring position are repeated three times to check reproducibility.

Measurement of Delivery Volume Efficiency

The application device is firmly inserted through the bottom of a standard liquid container (such as a 50 ml centrifuge tube available from Corning No. 25330-50). To ensure a secure arrangement, the size of the orifice through which the application device is inserted is cut to the size of the application device and a silicone based sealant used. This unit is then clamped into position beneath a compressor unit (such as a Lloyd LR5K Compression meter). This arrangement provides a consumer realistic vertical load of 3N. The application device is placed in contact with an absorbent pad comprised of a bicomponent synthetic fibre top layer above a fluffy pulp base layer. The pad allows rapid transport away from the point of delivery so as not to reduce the concentration gradient and hence reduce flow. The container is then filled with the stain removing solution (such as Example 1) to a level of 20 ml. The amount of fluid that flows per unit time is measured by noting the loss of fluid from the reservoir over a fixed period. The delivery volume efficiency is then calculated by normalising the flow rate with respect to the total surface area of contact ($mm^2$) between the application device and the fabric. Measurements are repeated three times to check reproducibility.

What is claimed is:

1. An applicator comprising a no rinse fabric treatment composition and an application device, wherein said application device has a frictional stress value of from 0.05 N $mm^{-2}$ to 10 N $mm^{-2}$.

2. An applicator according to claim 1 wherein said application device has a frictional stress value of from 0.1 N $mm^{-2}$ to 1 N $mm^{-2}$.

3. An applicator according to claim 1 wherein said application device is a nib.

4. An applicator according to claim 3 wherein said nib comprises synthetic fibers.

5. An applicator according to claim 3 wherein said nib comprises felt.

6. An applicator according to claim 1 wherein said composition comprises a peroxide bleach.

7. An applicator according to claim 1 wherein said composition further comprises at least 70% water.

8. An applicator according to claim 1 further comprising a housing, wherein said housing is pen-shaped.

9. An applicator according to claim 1 wherein said application device has a delivery volume efficiency of from 0.0005 ml $mm^{-2}$ $s^{-1}$ to 0.1 ml $mm^{-2}$ $s^{-1}$.

10. An applicator according to claim 1 wherein said application device has a contact area of from 0.25 $mm^2$ to 400 $mm^2$.

* * * * *

UNITED STATES PATENT AND TRADEMARK OFFICE

CERTIFICATE OF CORRECTION

PATENT NO. : 6,644,879 B2 
DATED : November 11, 2003
INVENTOR(S) : Ann Margaret Irvin et al.

It is certified that error appears in the above-identified patent and that said Letters Patent is hereby corrected as shown below:

Title page,
Insert Item:

-- Related U.S. Application Data

[63] Continuation application of International Application No. PCT/US00/18913, filed July 11, 2000, designating the U.S., which claims priority to EP Application No. 99113433.9, filed July 12, 1999. --.

Column 1,
Line 4, add -- This application is a continuation application of International Application No. PCT/US00/18913, filed July 11, 2000, designating the U.S., which claims priority to EP Application No. 99113433.9, filed July 12, 1999. --

Signed and Sealed this

Fourth Day of April, 2006

JON W. DUDAS
*Director of the United States Patent and Trademark Office*